US006326923B2

(12) United States Patent
Shigihara

(10) Patent No.: US 6,326,923 B2
(45) Date of Patent: Dec. 4, 2001

(54) SMALL-SIZED CIRCULAR POLARIZED WAVE MICROSTRIP ANTENNA PROVIDING DESIRED RESONANCE FREQUENCY AND DESIRED AXIS RATIO

(75) Inventor: Makoto Shigihara, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/784,614

(22) Filed: Feb. 15, 2001

(30) Foreign Application Priority Data

Feb. 18, 2000 (JP) ..... 12-041573

(51) Int. Cl.[7] ..... H01Q 1/38
(52) U.S. Cl. ..... 343/700 MS; 343/846
(58) Field of Search ..... 343/700 MS, 767, 343/770, 829, 846; H01Q 1/38, 21/06, 21/24, 21/26

(56) References Cited

U.S. PATENT DOCUMENTS

| | | | | |
|---|---|---|---|---|
| 5,216,430 | * | 6/1993 | Rahm et al. | 343/700 MS |
| 5,243,353 | * | 9/1993 | Nakahara et al. | 343/700 MS |
| 5,410,323 | * | 4/1995 | Kuroda | 343/700 MS |
| 5,745,080 | * | 4/1998 | Jun | 343/700 MS |
| 6,211,825 | * | 4/2001 | Deng | 343/700 MS |

FOREIGN PATENT DOCUMENTS 2000-151261 5/2000 (JP) .

* cited by examiner

*Primary Examiner*—Tho Phan
(74) *Attorney, Agent, or Firm*—Brinks Hofer Gilson & Lione

(57) ABSTRACT

The present invention provides a miniaturized circular polarized microstrip antenna that employs a dielectric substrate having a large relative dielectric constant so that a desired resonance frequency and a desired axis ratio are obtained. In a circular polarized wave microstrip antenna 1 having a nearly square dielectric substrate 4 with a nearly square patch electrode 2 formed on one surface thereof, and a ground electrode 3 formed on almost the whole of another surface thereof, triangular first notches 2*a* and 2*b* serving as retraction-separation elements are respectively formed 135 and 315 degrees with respect to a direction toward a feeding point 5 from the center of the patch electrode 2, which is defined as 0, and within the first notch 2*b*, a first adjustment electrode 2*c* extending outwardly from an edge of the patch electrode 2 is formed. On the other hand, a triangular second notch 2*d* is formed 45 degrees with respect to a direction toward the feeding point 5 from the center of the patch electrode 2, which is defined as 0, and within the second notch 2*d*, a second adjustment electrode 2*e* extending outwardly from an edge of the patch electrode 2 is formed.

4 Claims, 10 Drawing Sheets

SMALL-SIZED CIRCULAR POLARIZED WAVE MICROSTRIP ANTENNA PROVIDING DESIRED RESONANCE FREQUENCY AND DESIRED AXIS RATIO

BACKGROUND OF THE INVENTION

1. Field of the Invention

The present invention relates to a circular polarized microstrip antenna having a dielectric substrate with a patch electrode formed on one surface thereof, and a ground electrode formed on another surface thereof.

2. Description of the Prior Art

Recently, there has been an active move to incorporate a GPS antenna in portable equipment to thereby build a portable navigation system or obtain position information and the like by Cellular Phone in urgent communications, resulting in an increasing demand for very small-sized antennas.

FIG. 11 is a plan view of a conventional circular microstrip antenna 101 in wide use. The microstrip antenna 101 has a nearly square dielectric substrate 104 with a nearly square patch electrode 102 formed on one surface thereof, and a ground electrode (not shown) formed on almost the whole of another surface thereof. The patch electrode 102 has a feeding point 105 formed slightly away from the center thereof, to which power is fed through a coaxial cable (not shown) from the ground electrode. The patch electrode 102 has a pair of notches 102*a* and 102*b* formed so that they are positioned 135 and 315 degrees, respectively, with respect to a direction toward the feeding point 105 from the center of the patch electrode 102 , which is defined as 0 degree. These notches 102 and 102*b*, called retraction-separation elements, function to separate two modes (M1 and M2 in FIG. 11) perpendicular to each other, retracted in the microstrip antenna 101, and enable the microstrip antenna 101 to send or receive right-handed circular polarized radio waves.

In the square microstrip antenna 101 thus configured, its resonance frequency fr is generally given by the following expression (1).

[Expression 1]

$$fr = \frac{c}{2a_{eff}\sqrt{\varepsilon_r}} \tag{1}$$

$$a_{eff} = a\left\{1 + 0.824\frac{h(\varepsilon_e + 0.3)(a/h + 0.262)}{a(\varepsilon_e - 0.258)(a/h + 0.813)}\right\}$$

$$\varepsilon_e = \frac{\varepsilon_r + 1}{2} + \frac{\varepsilon_r - 1}{2}\left(1 + 10\frac{h}{a}\right)^{\frac{1}{2}}$$

In the expression (1), c is a light speed, ∈r is the relative dielectric constant of a relative dielectric substrate 104, h is the thickness of the relative dielectric substrate 104, and a is the length of one side of the square patch electrode 102.

It will be appreciated from the above expression (1) that a small-sized microstrip antenna 101 is achieved by using the dielectric substrate 104 having a large relative dielectric constant ∈r. For example, where the microstrip antenna 101 is used for GPS receiving, when ∈r=20, the length of one side of the dielectric substrate 104 is approximately 25 mm, while, when ∈r=90, the length of one side of the dielectric substrate 104 is reduced to approximately 12 mm. For this reason, as the dielectric substrate 104, microwave dielectric ceramics (hereinafter simply referred to as ceramics) having large relative dielectric constants ∈r are often used.

FIG. 12 represents changes of resonance frequency fr for variations in the size of one side of a square patch electrode.

In the drawing, the dashed line G is for the dielectric substrate when ∈r=20, and the dashed line H is for the dielectric substrate when ∈r=90. As seen from FIG. 12, the larger is the relative dielectric constant ∈r, the greater are the changes of the resonance frequency fr for variations of the size of the patch electrode. Herein, size variations of the patch electrode affect not only the length of one side but also, e.g., the notches 102*a* and 102*b*, resulting in changing not only the resonance frequency fr but also a circular polarized wave generation frequency and even its axis ratio.

FIG. 13 represents changes of the resonance frequency fr for variations of relative dielectric constant ∈r. In the drawing, the dashed line I is for the dielectric substrate when ∈r=20, and the dashed line J is for the dielectric substrate when ∈r=90. It will be appreciated from FIG. 13 that although the magnitude of relative dielectric constants contributes less in comparison with the case of FIG. 12, the larger is the relative dielectric constant ∈r, the greater are the changes of the resonance frequency fr.

Therefore, although the above-described conventional microstrip antenna 101 is advantageous in that it can be miniaturized by using the dielectric substrate 104 having a large relative dielectric constant ∈r, it is disadvantageous in that since it is greatly affected by variations in production quality and other factors, it is afflicted by resonance frequencies fr remarkably far from desired values, a large axis ratio, and other problems, resulting in reduced yields.

As a conventional method for solving these problems, a circular polarized microstrip antenna 110 as shown in FIG. 14 is proposed. The microstrip antenna 110 has a nearly square (or circular) patch electrode 112 formed on one surface of a dielectric substrate 114 wherein projections 116*a* to 116*d* for axis ratio adjustment, and projections 117*a* to 117*d* and conductor cutout portions 118*a* and 118*b* for frequency adjustment are formed in predetermined positions of the patch electrode 112. The projections 116*a* to 116*d* for axis ratio adjustment, which are retraction-separation elements, are formed 45, 135, 225, and 315degrees, respectively, with respect to a direction toward the feeding point 115 from the center of the patch electrode 112, which is defined as 0 degree. The projections 116*a* and 116*c* are formed longer than the projections 116*b* and 116*d*. The projections 117*a* to 117*d* for frequency adjustment are formed 0, 90, 180, and 270 degrees, respectively, and the conductor cutout portions 118*a* to 118*d* for frequency adjustment are formed in the vicinity of the bases of the projections 117*a* to 117*d*.

In the microstrip antenna 110 configured in this way, the projections 116*a* to 116*d* for axis ratio adjustment are each cut by an equal amount to adjust an axis ratio so that it becomes equal to or smaller than a defined value. If a resonance frequency after the axis adjustment is below a target frequency, the projections 117*a* to 117*d* for frequency adjustment are each cut by an equal amount to gradually increase the resonance frequency so that it becomes equal to the target frequency. If the projections 117*a* to 117*d* for frequency adjustment have been excessively cut to such an extent that the resonance frequency exceeds the target frequency, the conductor cutout portions 118*a* to 118*d* for frequency adjustment are cut to gradually decrease the resonance frequency so that it becomes equal to the target frequency.

On the other hand, if a resonance frequency after the axis adjustment is already equal to or greater than the target frequency, the conductor cutout portions 118*a* to 118*d* for frequency adjustment are cut to gradually decrease the resonance frequency so that it becomes equal to the target frequency. If the resonance frequency has decreased below the target frequency as a result of this operation, the projections 117*a* to 117*d* for frequency adjustment are each cut by an equal amount to gradually increase the resonance frequency so that it becomes equal to the target frequency.

As described previously, in the conventional microstrip antenna 110 shown in FIG. 14, since the projections 116*a* to 116*d* for axis ratio adjustment, and the projections 117*a* to 117*d* and conductor cutout portions 118*a* to 118*d* for frequency adjustment are formed in predetermined positions of the patch electrode 112, the projections 116*a* to 116*d* for axis ratio adjustment are cut to adjust the axis ratio so that it becomes equal to or smaller than the defined value, and then the projections 117*a* to 117*d* and conductor cutout portions 118*a* to 118*d* for frequency adjustment are cut, whereby the resonance frequency can be adjusted to the target frequency. However, the conventional microstrip antenna 110 has a problem in the following point. That is, the projections 116*a* to 116*d* for axis ratio adjustment, and the projections 117*a* to 117*d* and conductor cutout portions 118*a* to 118*d* for frequency adjustment do not function independent of each other, and even if the axis ratio has been set below the defined value by cutting the projections 116*a* to 116*d* for axis ratio adjustment, the axis ratio may be deteriorated again by subsequent cutting of the projections 117*a* to 117*d* and conductor cutout portions 118*a* to 118*d* for frequency adjustment. There is also a problem in that, if the projections 116*a* to 116*d* for axis ratio adjustment have been excessively cut carelessly, the rotation direction of circular polarized waves is reversed.

SUMMARY OF THE INVENTION

The present invention has been made in view of such a situation of the prior art and provides a circular polarized wave microstrip antenna that is miniaturized using a dielectric substrate having a large relative dielectric constant and is capable of providing a desired resonance frequency and a desired axis ratio.

The present invention is a circular polarized wave microstrip antenna having a dielectric substrate with a patch electrode formed on one surface thereof, and a ground electrode formed on almost the whole of another surface thereof, wherein, on one of two lines intersecting at right angles at the center of the patch electrode, a notch for retraction and separation is provided in at least one of facing edges of the patch electrode, and within the notch, an adjustment electrode extending outwardly from the edge of the patch electrode is provided.

With this configuration, by cutting the adjustment electrode, one of resonance frequencies relating to two modes retracted in the circular polarized microstrip antenna increases and an adjustment limit by the adjustment electrode is clarified. As a result, a circular polarized wave generation frequency can be easily and correctly adjusted to a desired frequency, so that yields can be greatly improved.

Also, according to the present invention, in addition to the above-described configuration, on the other of the two lines orthogonal to each other, a second notch smaller than the notch is provided in at least one of facing edges of the patch electrode, and within the second notch, a second adjustment electrode extending outwardly from the edge of the patch electrode is provided.

With this configuration, by cutting the adjustment electrode and the second adjustment electrode, the respective resonance frequencies relating to two modes retracted in the circular polarized microstrip antenna increase and an adjustment limit by the two adjustment electrodes is clarified. As a result, variations in resonance frequency in the circular polarized microstrip antenna not adjusted can be adjusted to a desired frequency with a small axis ratio.

In the above-described configuration, although the patch electrode is not limited in shape, for example, if the patch electrode is of square shape, it is desirable that the notch and the second notch are of nearly triangular shape. If the patch electrode is of circular shape, it is desirable that the notch and the second notch are of nearly rectangular or semicircular shape.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
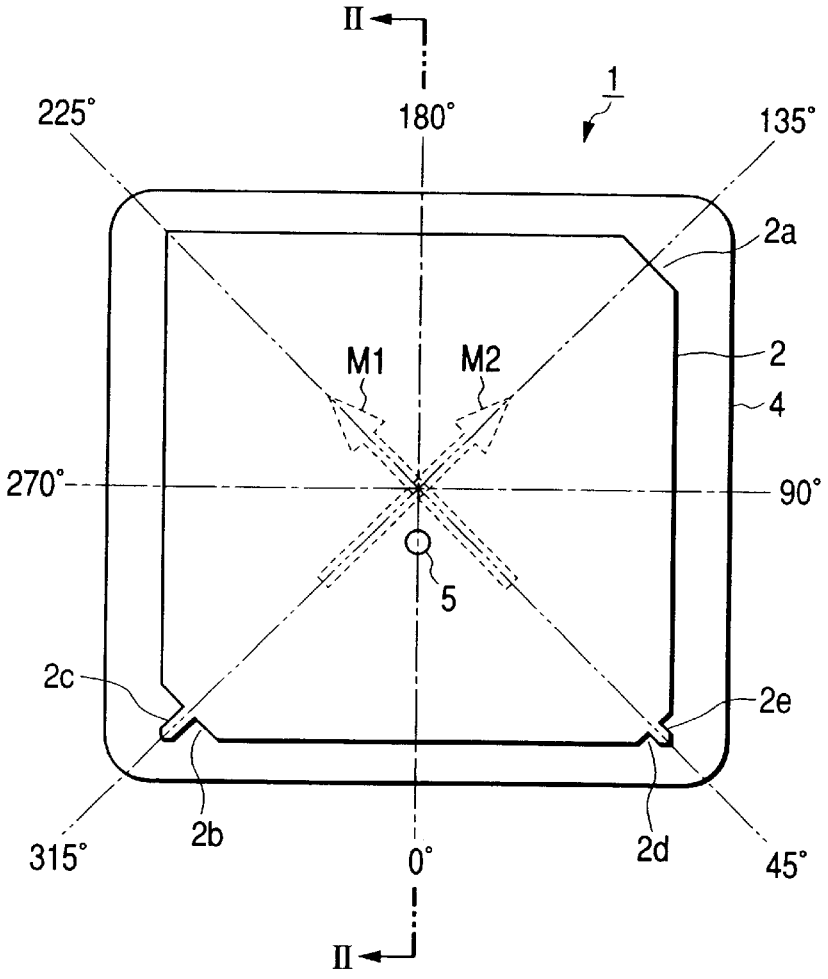
FIG. 1 is a plan view of a circular polarized wave microstrip antenna according to a first embodiment of the present invention.

Hereinafter, embodiments of the present invention will be described with reference to the accompanying drawings. FIG. 1 is a plan view of a circular polarized wave microstrip antenna according to a first embodiment of the present invention, and FIG. 2 is a sectional view taken along the II—II line of FIG. 1.

Figure 2:
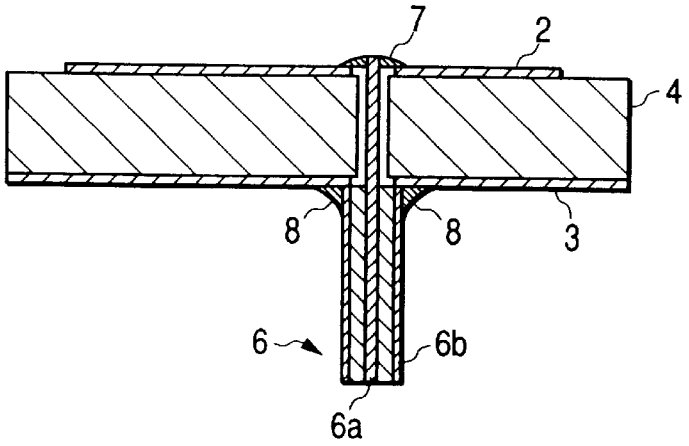
FIG. 2 is a sectional view taken along the II—II line of FIG. 1.

As shown in FIGS. 1 and 2, a circular polarized wave microstrip antenna 1 according to this embodiment has a nearly square dielectric substrate 4 with a nearly square patch electrode 2 formed on one surface thereof, and a ground electrode 3 formed on almost the whole of another surface thereof. A ceramic having a large relative dielectric constant is used as the dielectric substrate 4, and the patch electrode 2 and the ground electrode 3 are formed by printing copper paste and silver paste. The patch electrode 2 has a feeding point formed slightly away from the center thereof wherein power is fed to the feeding point 5 through a coaxial cable 6 from the surface on which the ground electrode 3 is formed. The coaxial cable 6 has an inside conductor 6*a* and an outside conductor 6*b* wherein the inside conductor 6*a* is connected to the patch electrode 2 by a soldering part 7 and the outside conductor 6*b* is connected to the ground electrode 3 by a soldering part 8.

First notches 2*a* and 2*b* are respectively formed 135 and 315 degrees with respect to a direction toward the feeding point from the center of the patch electrode 2, which is defined as 0, wherein the first notches 2*a* and 2*b* are of triangular shape resulting from cutting corners of the nearly square patch electrode 2. The first notches 2*a* and 2*b*, called retraction-separation elements, function to separate two modes (M1 and M2 in FIG. 1) perpendicular to each other, retracted in the microstrip antenna 1, and enable the microstrip antenna 1 to send or receive right-handed circular polarized radio waves. A first adjustment electrode 2*c* having a wedged tip is formed within the first notch 2*b* and extends outwardly from the edge (the bottom of the first notch 2*b*) of the patch electrode 2. The first adjustment electrode 2*c* is formed within the nearly square area of the fundamental patch electrode 2 so that, in this embodiment, the tip of the first adjustment electrode 2*c* coincides with the vertex of the first notch 2*b*. A second notch 2*d* is formed 45 degrees with respect to a direction toward the feeding point 5 from the center of the patch electrode 2, which is defined as 0 degree, wherein a second adjustment electrode 2*e* having a wedged tip is formed within the second notch 2*d*. The second notch 2*d* is also of triangular shape resulting from cutting a corner of the nearly square patch electrode 2 like the first notch 2*b* but has a smaller notch area than the first notch 2*b*. The second adjustment electrode 2*e* extends outwardly from the edge (the bottom of the second notch 2*d*) of the patch electrode 2 so that its tip coincides with the vertex of the second notch 2*d*.

If the dimension of the first notch 2*a* at the upper right corner is defined as ΔS1, the dimension of the first notch 2*b* at the lower left corner as ΔS2, the dimension of the second notch 2*d* as ΔS3, the area of the first adjustment electrode 2*c* as P2, and the area of the second adjustment electrode 2*e* at the lower right corner as P2, and the area of the second adjustment electrode 2*e* at the lower right corner as P3, a relation of (ΔS1+ΔS2−P2)>(ΔS3−P3) must be satisfied. However, the first notch 2*a* at the upper right corner may be omitted to use only the first notch 2*b* at the lower left corner, in which case a relation of (ΔS2−P2)>(ΔS3−P3) must be satisfied. If the dimension of the nearly square area of the fundamental patch electrode 2 is defined as S, the ratio of the dimensions of the portions is appropriately set by the relative dielectric constant ∈r of the dielectric substrate 4, the size of the patch electrode 2, and other factors. As one example, where the microstrip antenna 1 is used for GPS receiving (frequency 1.57542 GHz) and the relative dielectric constant ∈r of the dielectric substrate is 90, the length of one side of the nearly square area of the fundamental patch electrode 2 is about 9.5 mm, ΔS1/S⇆0.3%, ΔS2/S⇆0.4%, ΔS3/S⇆0.2%, P2/ΔS2⇆0.5, and P3/ΔS3⇆0.5.

A method of adjusting frequency in the above-described microstrip antenna 1 will be described with reference to characteristic diagrams of FIGS. 3 to 8. In FIGS. 3 to 8, the horizontal axis represents frequency and the vertical axis represents VSWR (voltage standing wave ratio).

Figure 3:
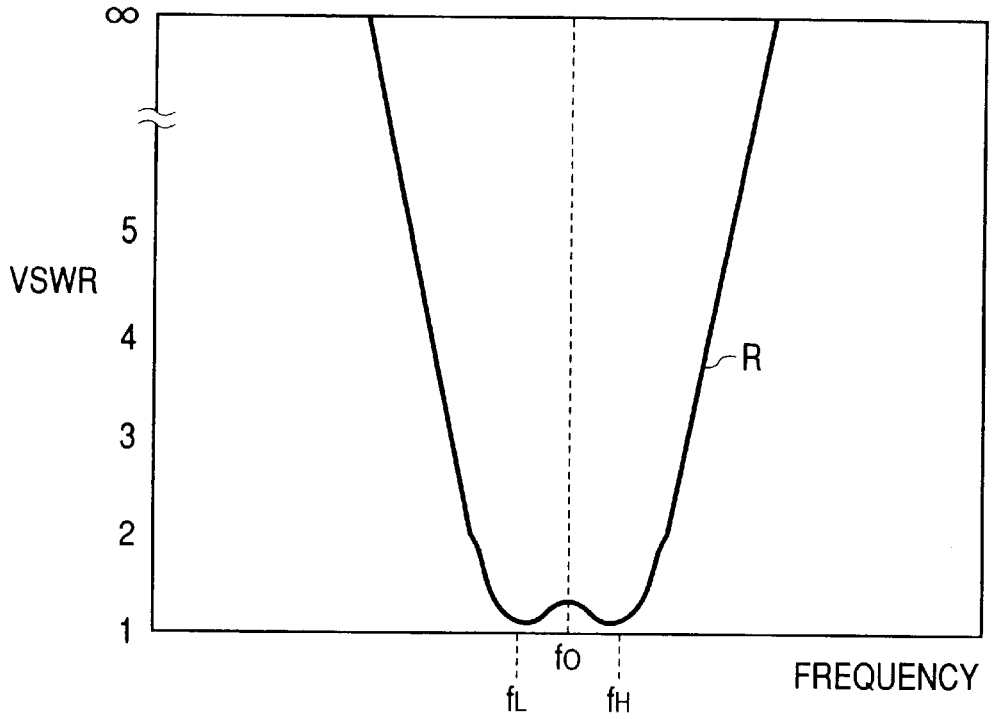
FIG. 3 illustrates VSWR characteristics when the circular polarized wave microstrip antenna generates ideal circular polarized waves.
Figure 4:
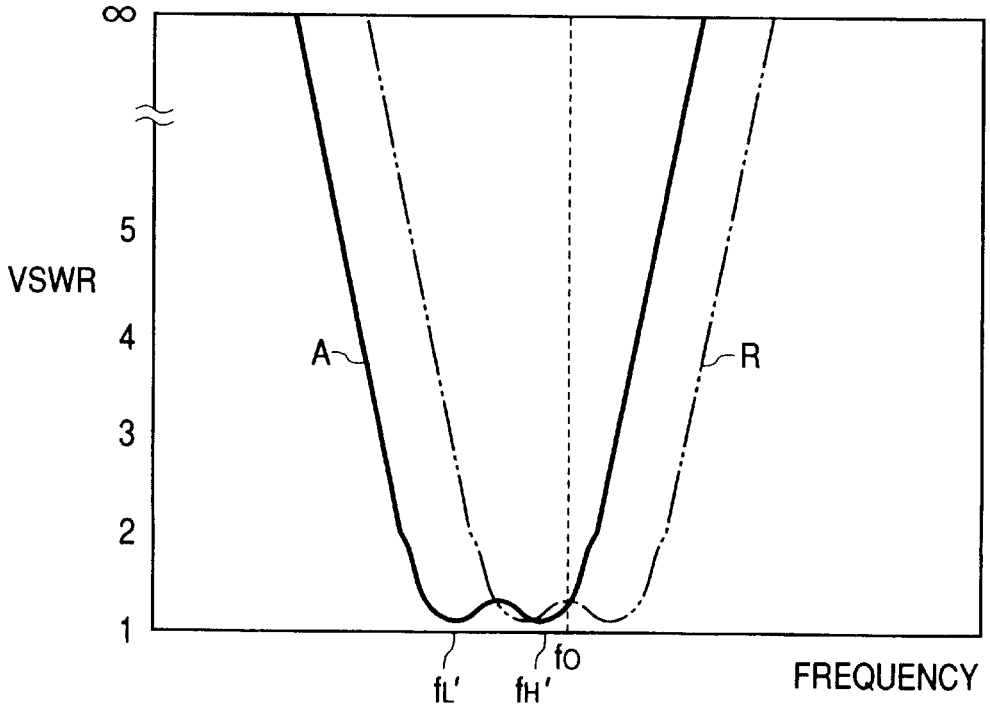
FIG. 4 illustrates an example of VSWR characteristics when the circular polarized wave microstrip antenna is not adjusted.

The solid line R of FIG. 3 indicates VSWR characteristics when a circular polarized wave microstrip antenna generates ideal circular polarized waves. In the drawing, fL indicates a resonance frequency relating to the first mode M1 in FIG. 1 and fH indicates a resonance frequency relating to the second mode M2 in FIG. 1. The solid line R in FIG. 3 indicates the case where an ideal circular polarized wave is generated at a nearly central desired frequency F0 between fL and fH, in which case frequency adjustments are not performed. As already described, as the relative dielectric constant of the dielectric substrate 4 increases, although the microstrip antenna 1 becomes smaller-sized, since size variations of the patch electrode 2 and variations of relative dielectric constant exert greater influence on resonance frequency, fL and fH shown in FIG. 3 show different frequencies for each of fabricated individual circular polarized microstrip antennas In the circular polarized wave microstrip antenna 1 of this embodiment, since a fundamental resonance frequency is given by the expression (1), by approximately setting the length a of one side of the patch electrode 2, and the relative dielectric constant ∈r and width h of the dielectric substrate 4, as indicated by the solid line A of FIG. 4, resonance frequencies at no adjustment are set to obtain VSWR characteristics shifted slightly toward lower frequencies from the ideal VSWR characteristics (the alternate long and two short dashes line R of FIG. 4). In FIG. 4, fL' and fH' indicate two resonance frequencies at no adjustment and the difference (fH'−fL') between these resonance frequencies is almost equal to the difference (fH−fL) between the two resonance frequencies in the alternate long and two short dashes line R. If resonance frequencies at no adjustment exhibit the VSWR characteristics as indicated by the solid line A of FIG. 4, by cutting the first adjustment electrode 2*c* and the second adjustment electrode 2*e* by almost equal amount to bring the VSWR characteristics indicated by the solid line A into line with the VSWR characteristics indicated by the alternate long and two short dashes line R, in other words, to increase the resonance frequencies fL' and fH' to fL and fH, respectively, the resonance frequency of the microstrip antenna 1 is adjusted to a desired frequency. In this case, since the first adjustment electrode 2*c* and the second adjustment electrode 2*e* cannot be cut beyond the edges of the patch electrode 2, respectively, that is, the limit of adjustment amounts is determined by the notch positions of the first notch 2*b* and the second notch 2*d*, even if the first adjustment electrode 2*c* and the second adjustment electrode 2*e* were wholly cut, the rotation direction of circular polarized waves would not be reversed.

Figure 5:
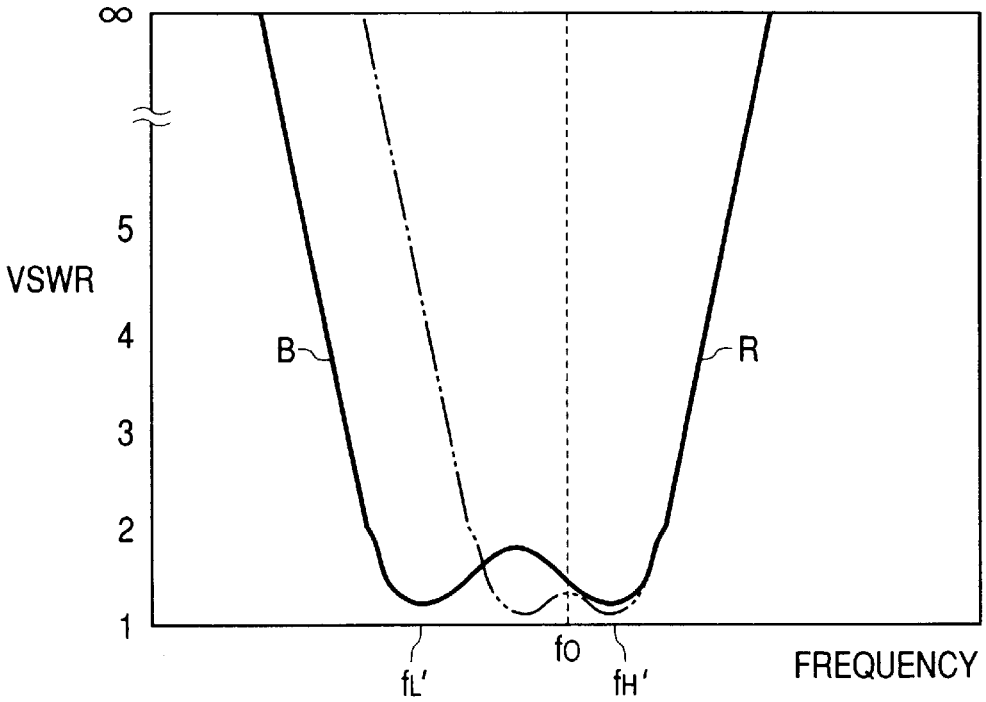
FIG. 5 illustrates an example of VSWR characteristics when the circular polarized wave microstrip antenna is not adjusted.

Resonance frequencies at no adjustment do not always exhibit the VSWR characteristics as indicated by the solid line A of FIG. 4, and different VSWR characteristics may occur for different resonance frequencies. For example, the VSWR characteristics indicated by the solid line B of FIG. 5 are shifted to a lower frequency only at one resonance frequency fL' from the ideal VSWR characteristics (the alternate long and two short dashes line R of FIG. 4) wherein a resonance frequency difference (fH'−fL') in the solid line B is greater than the difference between two resonance frequencies (fH−fL) in the alternate long and two short dashes line R. In such a case, by cutting only the second adjustment electrode 2*e*, adjustments are performed so that the VSWR characteristics of the solid line B become equal to the VSWR characteristics of the alternate long and two short dashes line R.

Figure 6:
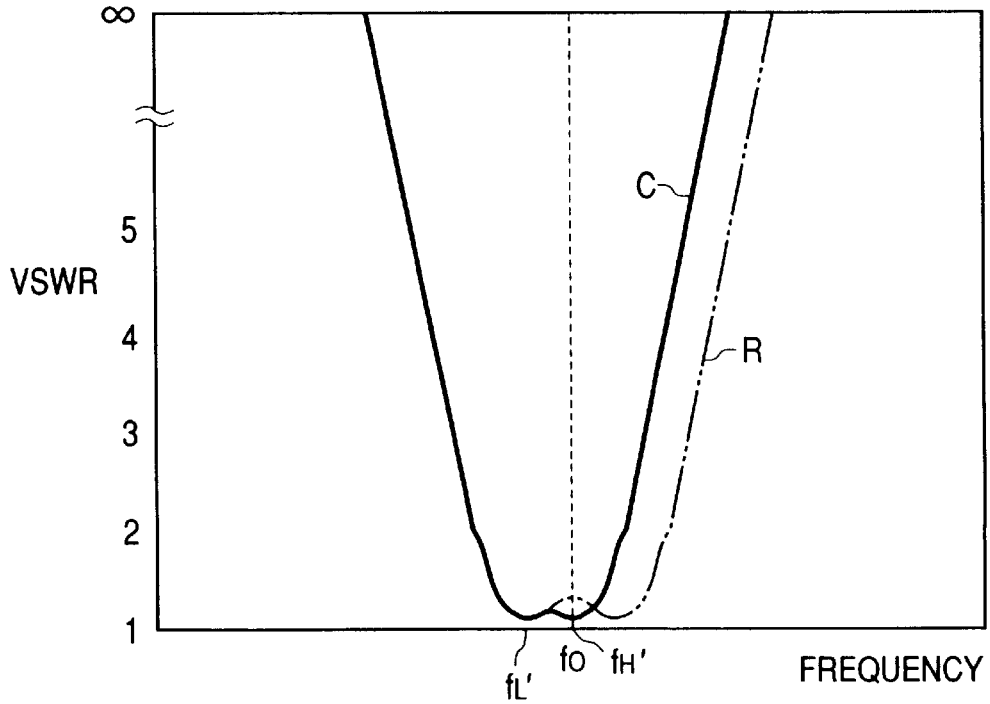
FIG. 6 illustrates an example of VSWR characteristics when the circular polarized wave microstrip antenna is not adjusted.

VSWR characteristics indicated by the solid line C of FIG. 6 are shifted to a lower frequency only at another resonance frequency fH' from the ideal VSWR characteristics (the alternate long and two short dashes line R of FIG. 6) wherein a resonance frequency difference (fH'−fL') in the solid line C is smaller than the difference between two resonance frequencies (fH−fL) in the alternate long and two short dashes line R. In such a case, in contrast to the case of FIG. 5, by cutting only the first adjustment electrode 2*c*, adjustments are performed so that the VSWR characteristics of the solid line C become equal to the VSWR characteristics of the alternate long and two short dashes line R.

Figure 7:
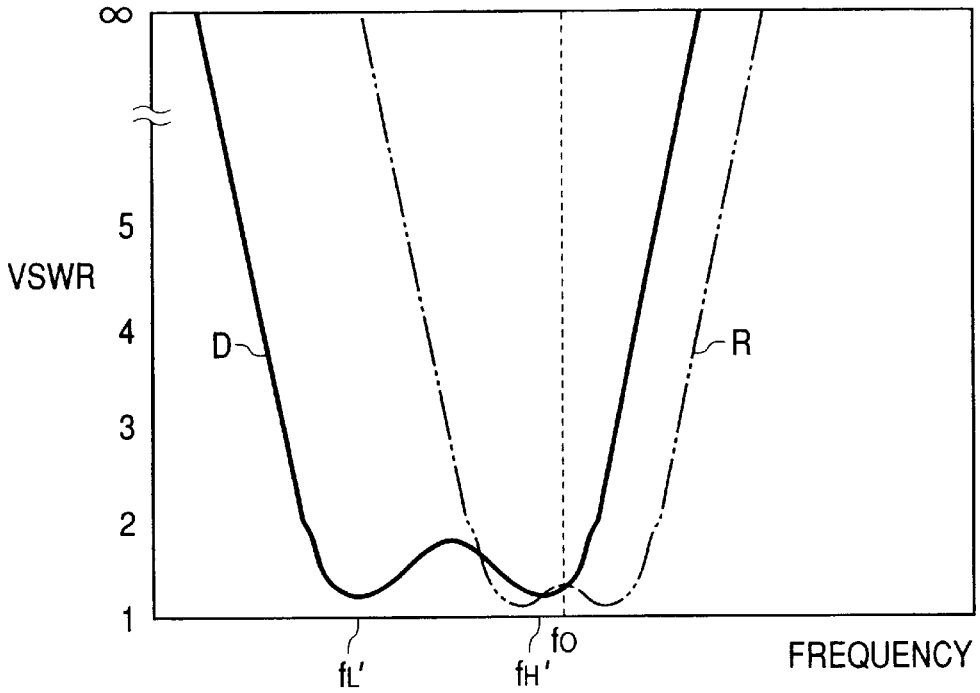
FIG. 7 illustrates an example of VSWR characteristics when the circular polarized wave microstrip antenna is not adjusted.

VSWR characteristics indicated by the solid line D of FIG. 7 are shifted to lower frequencies at both of the two resonance frequencies fL' and fH' from the ideal VSWR characteristics (the alternate long and two short dashes line R of FIG. 7) wherein fL' is shifted by a larger quantity than fH'. Accordingly, a resonance frequency difference (fH'−fL') in the solid line D is greater than the difference between two resonance frequencies (fH−fL) in the alternate long and two short dashes line R. In such a case, both the first adjustment electrode 2*c* and the second adjustment electrode 2*e* are cut but the first adjustment electrode 2*c* is cut by a larger amount than the second adjustment electrode 2*e*, whereby adjustments are performed so that the VSWR characteristics indicated by the solid line D become equal to the VSWR characteristics indicated by the alternate long and two short dashes line R.

Figure 8:
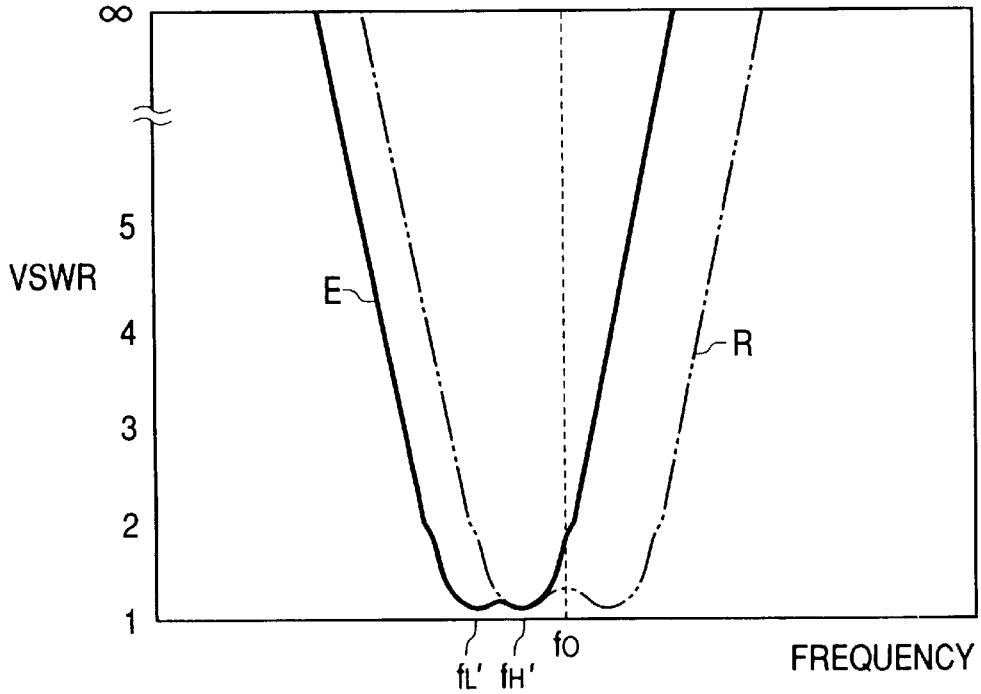
FIG. 8 illustrates an example of VSWR characteristics when the circular polarized wave microstrip antenna is not adjusted.

Furthermore, although VSWR characteristics indicated by the solid line E of FIG. 8 are shifted to lower frequencies at both the two resonance frequencies fL' and fH' from the ideal VSWR characteristics (the alternate long and two short dashes line R of FIG. 8), in contrast to the case of FIG. 7, fL' is shifted by a larger quantity than fH'. Accordingly, a resonance frequency difference (fH'−fL') in the solid line E is smaller than the difference between two resonance frequencies (fH−fL) in the alternate long and two short dashes line R. In such a case, both the first adjustment electrode 2*c* and the second adjustment electrode 2*e* are cut but the second adjustment electrode 2*e* is cut by a larger amount than the first adjustment electrode 2*c*, whereby adjustments are performed so that the VSWR characteristics indicated by the solid line E become equal to the VSWR characteristics indicated by the alternate long and two short dashes line R.

Figure 9:
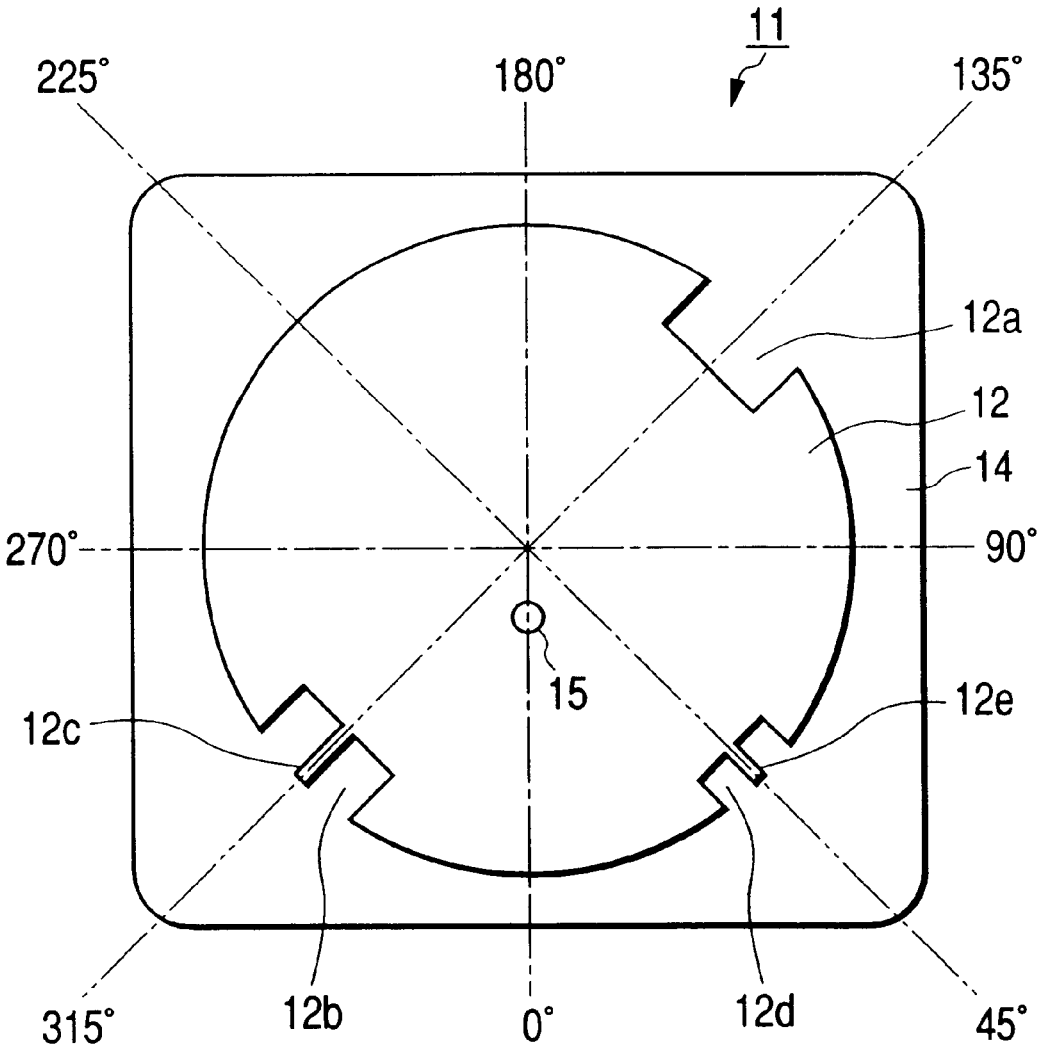
FIG. 9 is a plan view of the circular polarized wave microstrip antenna according to a second embodiment of the present invention.

FIG. 9 is a plan view of a circular polarized wave microstrip antenna according to a second embodiment of the present invention wherein a reference numeral 12 designates a patch electrode and a reference numeral 15 designates a feeding point.

The microstrip antenna 11 according to this embodiment is basically different from the microstrip antenna 1 shown in FIG. 1 in that a nearly circular patch electrode 12 is used instead of the nearly square patch electrode. Any of first notches 12*a* and 12*b*, and a second notch 12*d* is of nearly rectangular shape, and within the first notch 12*b* and the second notch 12*d*, a first adjustment electrode 12*c* and a second adjustment electrode 12*e* are respectively formed.

Figure 10:
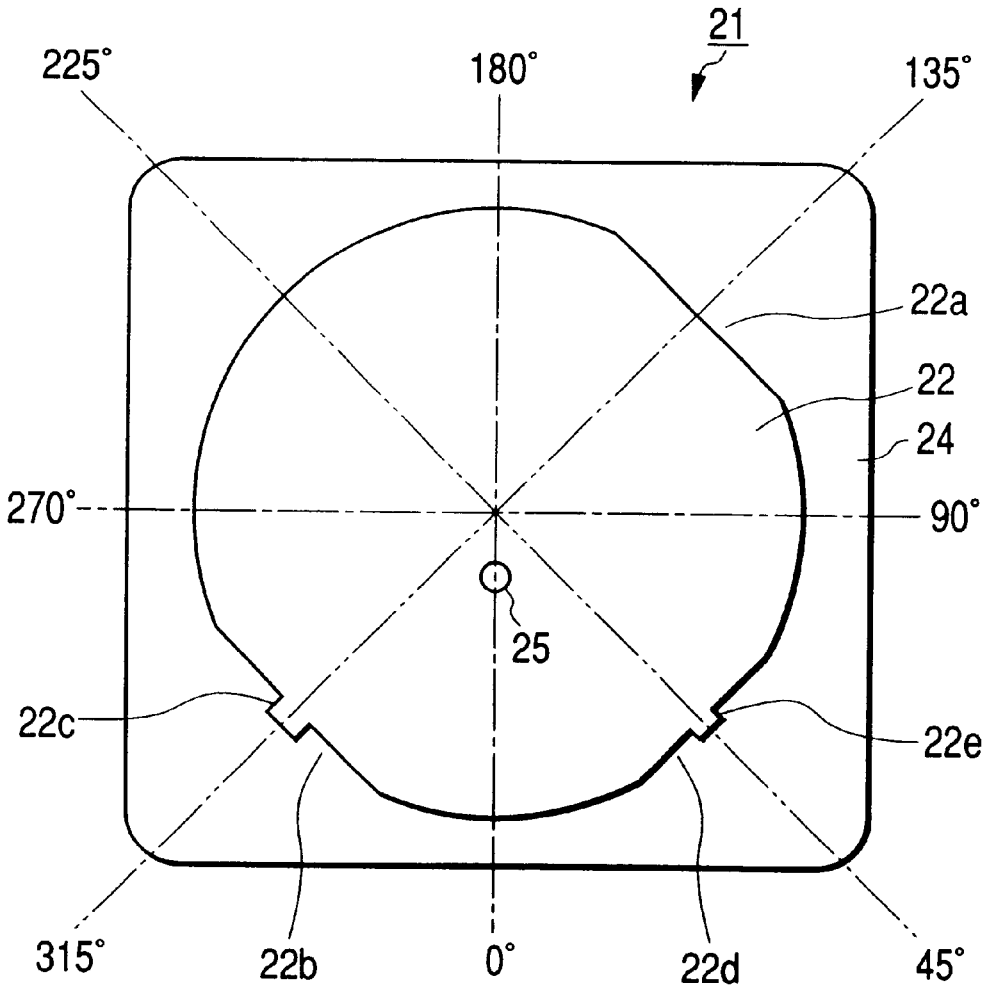
FIG. 10 is a plan view of a circular polarized wave microstrip antenna according to a third embodiment of the present invention.
Figure 11:
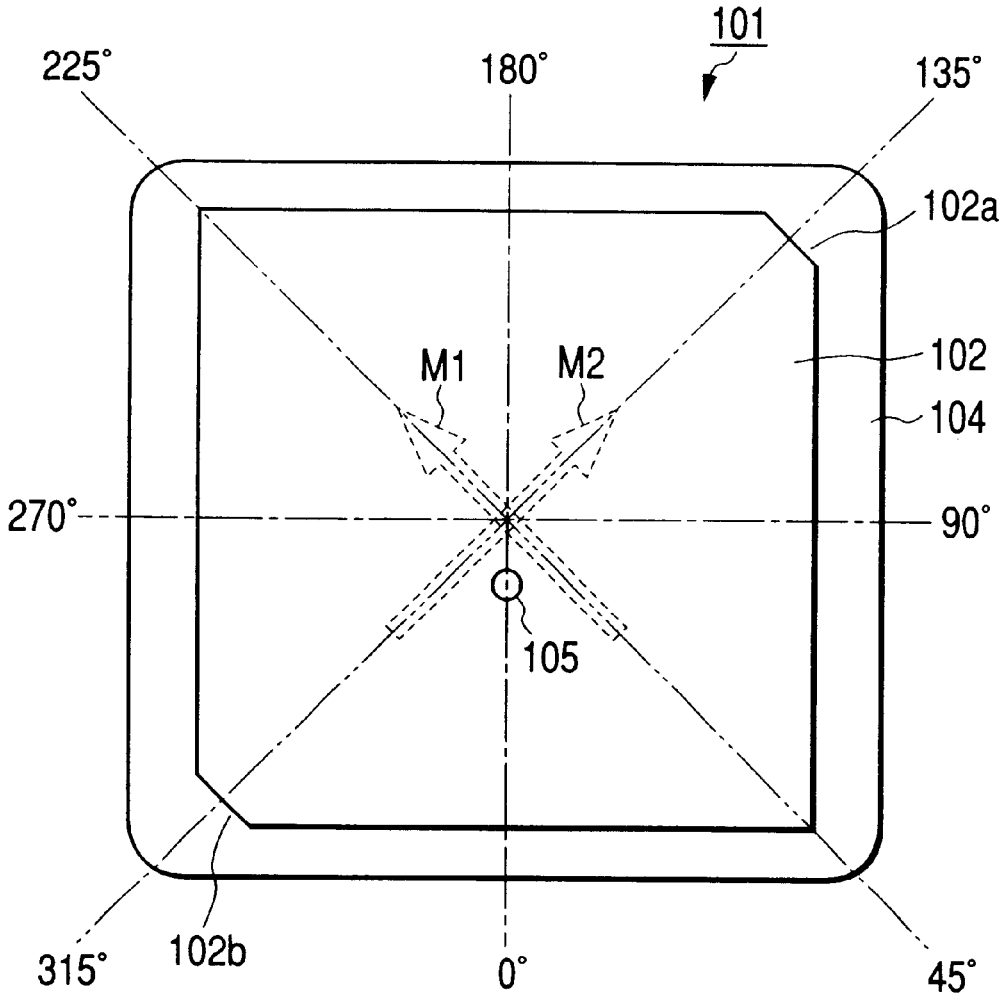
FIG. 11 PRIOR ART
FIG. 11 is a plan view of a conventional circular microstrip antenna.
Figure 12:
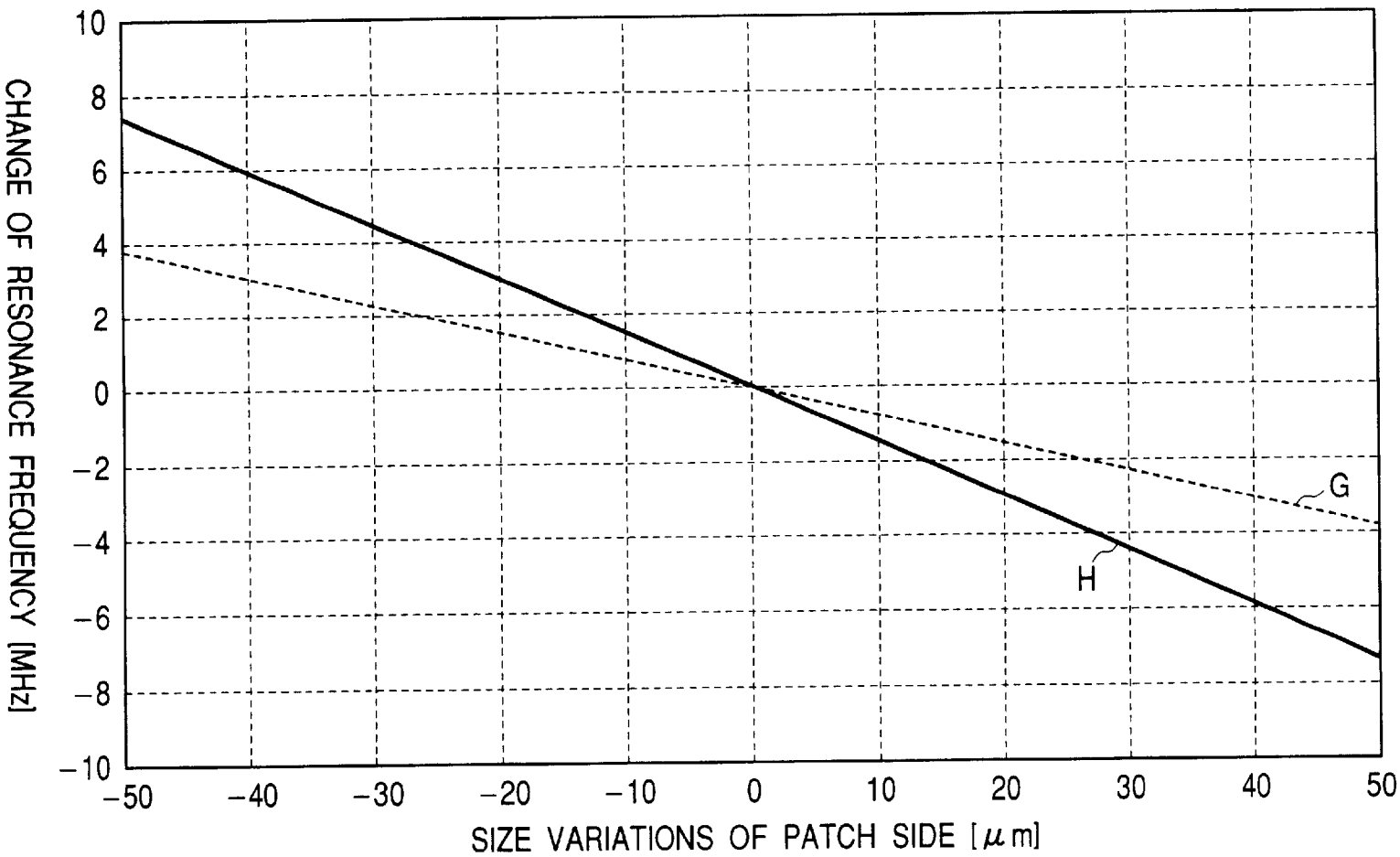
FIG. 12 PRIOR ART
FIG. 12 represents changes of resonance frequency for variations in the length of one side of a patch electrode in a square microstrip antenna.
Figure 13:
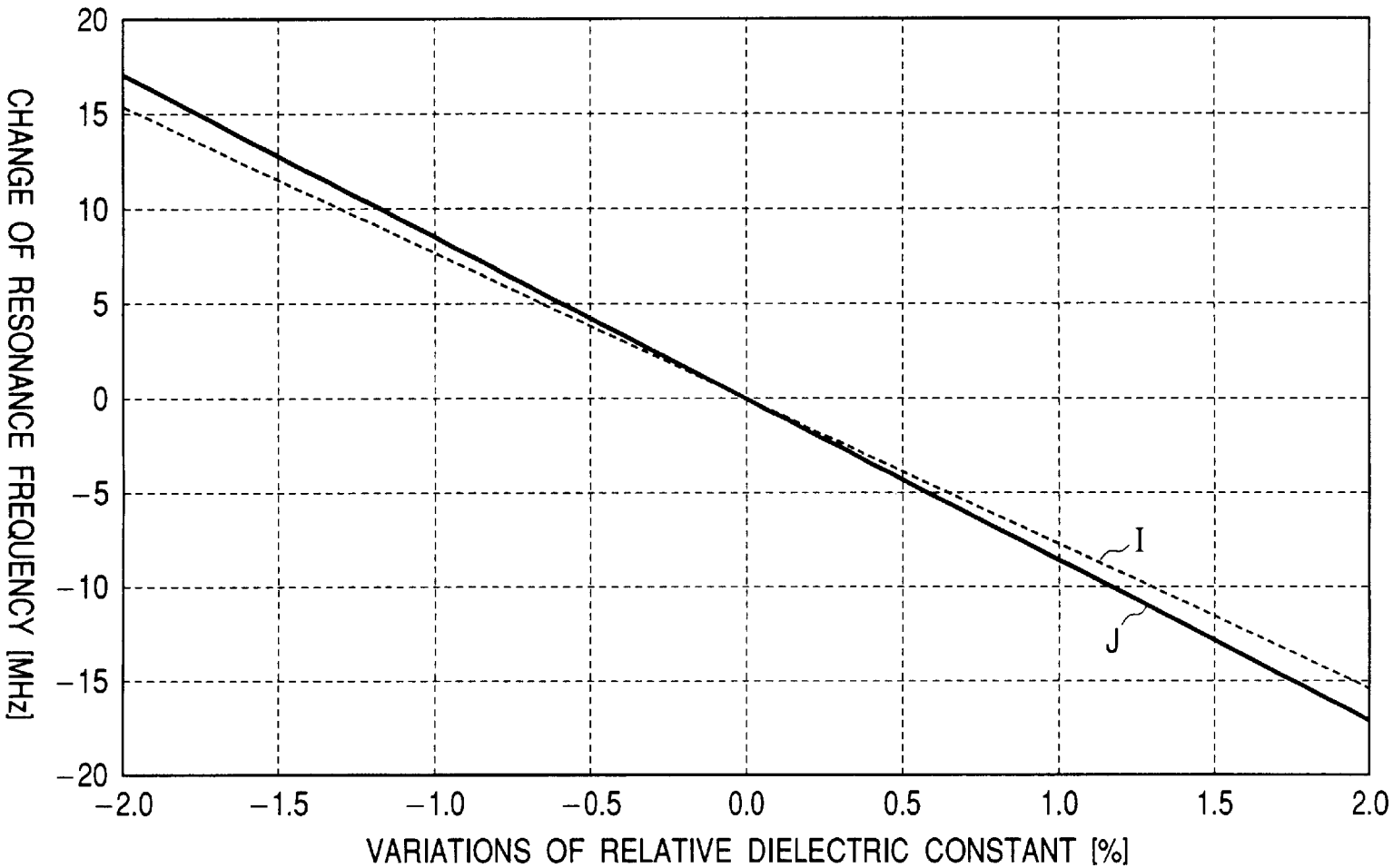
FIG. 13 PRIOR ART
FIG. 13 represents changes of resonance frequency for variations of relative dielectric constant of a dielectric substrate in the square microstrip antenna.
Figure 14:
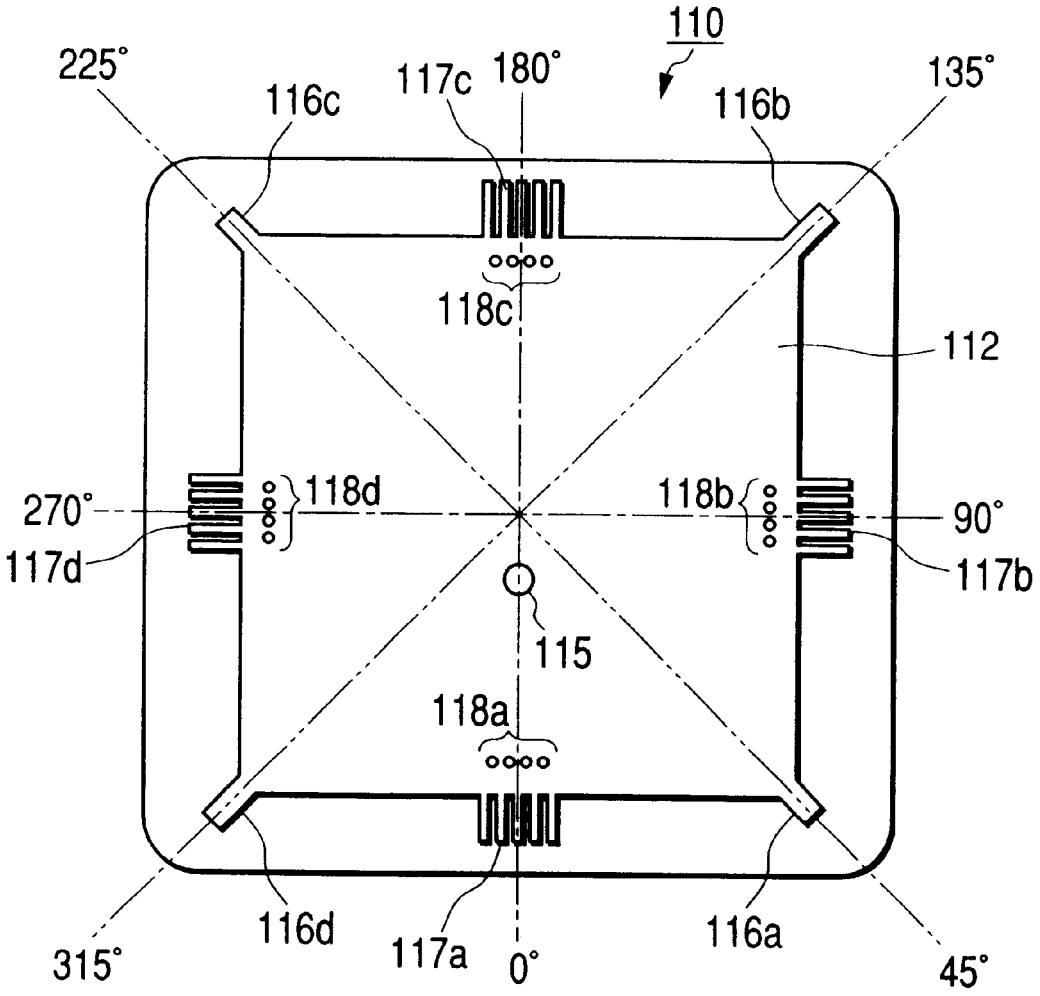
FIG. 14 PRIOR ART
FIG. 14 is a plan view showing another example of a conventional polarized wave microstrip antenna.

FIG. 10 is a plan view of a circular polarized wave microstrip antenna according to a third embodiment of the present invention wherein a reference numeral 22 designates a patch electrode and a reference numeral 25 designates a feeding point.

Although the patch electrode 22 is of nearly circular shape also in a microstrip antenna 21 according to the present invention, any of first notches 22*a* and 22*b*, and a second notch 22*d* is of nearly semicircular shape, and within the first notch 22*b* and the second notch 22*d*, a first adjustment electrode 22*c* and a second adjustment electrode 22*e* are respectively formed.

A method of adjusting frequencies in the second and third embodiments is the same as that in the first embodiment already made. Therefore, a description of the adjustment method is omitted herein.

The present invention is implemented in the embodiments as described above, and has effects as described below.

On one of two lines intersecting at right angles at the center of a patch electrode, a notch for retraction and separation is provided in at least one of facing edges of the patch electrode, and within the notch, an adjustment electrode extending outwardly from the edge of the patch electrode is provided. With this configuration, by cutting the adjustment electrode, one of resonance frequencies relating to two modes retracted in the circular polarized microstrip antenna increases and an adjustment limit by the adjustment electrode is clarified. As a result, a circular polarized wave generation frequency can be easily and correctly adjusted to a desired frequency, so that yields can be greatly improved.

What is claimed is:

1. A circular polarized wave microstrip antenna having a dielectric substrate with a patch electrode formed on one surface thereof, and a ground electrode formed on almost the whole of another surface thereof, wherein, on one of two lines intersecting at right angles at the center of the patch electrode, a notch for retraction and separation is provided in at least one of facing edges of the patch electrode, within the notch, an adjustment electrode extending outwardly from the edge of the patch electrode is provided, on the other line of the two intersecting lines, a second notch, which is smaller than said notch, is provided in at least one of the facing edges of the patch electrode, and a second adjustment electrode extending outwardly from the edge of the patch electrode is provided within the second notch.

2. The circular polarized wave microstrip antenna according to claim 1, wherein the patch electrode is of square shape, the notch is of nearly triangular shape, and the second notch is of nearly triangular shape.

3. The circular polarized wave microstrip antenna according to claim 1, wherein the patch electrode is of circular shape, the notch is of nearly rectangular shape, and the second notch is of nearly rectangular shape.

4. The circular polarized wave microstrip antenna according to claim 1, wherein the patch electrode is of circular shape, the notch is of nearly semicircular shape, and the second notch is of nearly semicircular shape.

* * * * *

UNITED STATES PATENT AND TRADEMARK OFFICE

CERTIFICATE OF CORRECTION

PATENT NO. : 6,326,923 B2 
DATED : December 4, 2001
INVENTOR(S) : Makoto Shigihara It is certified that error appears in the above-identified patent and that said Letters Patent is hereby corrected as shown below:

Title page,
Foreign Application Priority Data, delete "12-041573" and substitute -- 2000-041573 -- in its place.

Signed and Sealed this

Seventeenth Day of September, 2002

*Attest:*

*Attesting Officer*

JAMES E. ROGAN
*Director of the United States Patent and Trademark Office*